United States Patent [19]

Felton, Jr.

[11] 4,043,925

[45] Aug. 23, 1977

[54] LOW SMOKING COMPOSITION AND METHOD FOR COLD HEADING OPERATIONS

[75] Inventor: George F. Felton, Jr., Chadds Ford, Pa.

[73] Assignee: Suntech, Inc., St. Davids, Pa.

[21] Appl. No.: 670,607

[22] Filed: Mar. 26, 1976

Related U.S. Application Data

[63] Continuation-in-part of Ser. No. 532,562, Dec. 13, 1974, abandoned.

[51] Int. Cl.[2] ..... C10M 1/06

[52] U.S. Cl. ..... 252/49.3; 72/42; 252/49.5

[58] Field of Search ..... 252/18, 33.6, 42.1, 252/47.5, 49.3, 49.6, 52 A, 49.5; 72/42

[56] References Cited

U.S. PATENT DOCUMENTS

| | | | |
|---|---|---|---|
| 2,237,096 | 4/1941 | Dearborn | 252/33.6 X |
| 2,981,686 | 4/1961 | Reamer | 252/33.6 |
| 3,227,652 | 1/1966 | Ackerman | 252/49.3 X |
| 3,278,430 | 10/1966 | Williams | 252/42.1 X |
| 3,526,596 | 9/1970 | Kress et al. | 252/52 A X |
| 3,980,571 | 9/1976 | Marx | 252/49.3 X |
| 3,983,044 | 9/1976 | Felton | 252/33.6 |

*Primary Examiner*—Delbert E. Gantz
*Assistant Examiner*—Andrew H. Metz
*Attorney, Agent, or Firm*—J. Edward Hess; Donald R. Johnson; Anthony Potts, Jr.

[57] ABSTRACT

Improved low smoking composition and method for cold forming metal parts is disclosed. The composition contains water, block copolymer of ethylene oxide and polypropylene oxide and which copolymer has a molecular weight of from about 1800 to about 2900, a sulfo-chlorinated fatty acid, potassium hydroxide and a compound having the following structure:

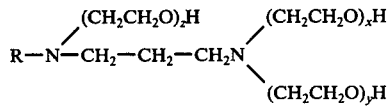

wherein R is a $C_{10}$–$C_{20}$ aliphatic group and the total of $z$, $x$ and $y$ are such that the compound is water soluble. The composition also has utility as a lubricant for plain bearings and ways.

12 Claims, No Drawings

LOW SMOKING COMPOSITION AND METHOD FOR COLD HEADING OPERATIONS

CROSS REFERENCE TO RELATED APPLICATION

This application is a continuation-in-part of applicant's application Ser. No. 532,562, filed Dec. 13, 1974, now abandoned.

BACKGROUND OF THE INVENTION

In the past cold working metal parts generally have been lubricated with oil-based lubricants. This lubrication with oil gives good die life and satisfactory finished product by results in considerable smoking during the operation.

SUMMARY OF THE INVENTION

The present invention relates to a water-based liquid for use in cold-forming metal parts such as nuts, bolt heads, etc. The liquid provides an aqueous solution of a polyalkylene gycol which precipitates out of solution to provide a solid lubricant at elevated tempertures. The liquid also employs extreme pressure additives, an anticorrosion agent and a defoamer. The resulting composition has a much lower smoke level in use than previously used materials and results in cold-formed parts which have a bright metallic appearance rather than the scorched appearance which is typical when an oil-based liquid is used. The blend is also an excellent lubricant for plain bearings and ways and can be employed in the lubricating side of a cold forming machine. This eliminates the possibility of cross contamination of a liquid with petroleum lubricating oil, small amounts of which would greatly increase smoking. The blend of the present invention also exhibits excellent freezing stability, i.e., after freezing it again forms a homogeneous mixture. Further, the blend remains homogeneous on heating to 212° F. or boiling temperature.

DESCRIPTION OF THE INVENTION

Cold forming operations are commonly used to form many articles. The mechanical working of the metal involved strengthens the metal so that many common metallic parts such as nuts, bolt heads, rivet heads, etc., are formed in this way. The technique is most commonly applied to carbon steels. The steel starting piece is generally a rod or wire which is cut or sheared to give a blank of the desired size. This blank is then stamped with one or more dies to form it into the desired shape. Although the metal blank starts off at ambient temperature it reaches elevated temperatures of several hundred degrees Fahrenheit during the process due to the internal friction developed in the forming process.

The present invention provides an aqueous solution which can be sprayed or flooded onto the workpiece. As the workpiece becomes hot due to mechanical working the lubricant is precipitated from the water and provides the lubrication necessary for satisfactory parts and generates much less smoke.

The materials which provide this function are water and a block copolymer which has a central portion of polypropylene oxide with polyethylene oxide on each end. Polypropylene oxide alone is unsatisfactory for this purpose because while liquid at desired molecular weight it is inadequately soluble in water. Polyethylene oxide of the desired molecular weight is a solid at ordinary temperatures and for this reason is unsatisfactory.

The block copolymer provides a liquid at ordinary temperatures with sufficient hydrophilic ethylene oxide groups to provide solubility in water. The molecular weight of the copolymer is between about 1800 to about 2900 with from 2000 to 2400 the preferred range. Generally the copolymer will contain from about 35 to 45 weight percent ethylene oxide and from 55 to 65 weight percent propylene oxide.

The composition generally will contain about 30 to 200 parts by weight of water and about 20 to 40 parts by weight of the above-described copolymer.

The combination of the copolymer, which is relatively low smoking and water gives this liquid the unique ability to do an excellent job of cold forming lubricating bearings and ways, inhibiting corrosion, and still produce significantly lower levels of smoke than other liquids.

To improve the load carrying ability of the composition extreme pressure additives are included therein. About 10 to 30 parts by weight of the following sulfochlorinated fatty acid are incorporated into the composition. It contains about 0.5 to 1.5 parts by weight sulfur and about 4 to 7 parts by weight chlorine. The material is a naturally occurring fatty acid which has been reacted with the sulfur and chlorine. Generally, the fatty acid portion will have 12–24 carbon atoms and at least 45% of the fatty acid moiety will contain at least 1 double bond. Generally, this unsaturated acid is oleic acid. The fatty acid is also reacted with enough moles of ethylene oxide to impart good water solubility. For additional details regarding said fatty acids see Oil, Fats & Waxes, C. Griffiths, Scientific Publications (Great Britain) Ltd., 1954; also, Fatty Acids and their Derivatives, A. W. Ralston, John Wiley & Sons, Inc., N. Y.

The composition also contains a corrosion inhibitor. Generally about 1.0 to 10 parts by volume of corrosion inhibitor is incorporated in the composition.

A suitable inhibitor is one having the following structure:

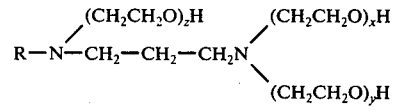

wherein R is a $C_{10}$–$C_{20}$ aliphatic group, preferably a $C_{10}$–$C_{20}$ alkenyl or paraffinic group; more preferably the alkenyl is a monoolefinic group. A mixture of compounds containing different R's can be used. And the total value of $z$, $x$ and $y$ are such that the compound contains sufficient amounts of ethylene oxide so that the compound is water soluble. Generally the total value of $z$, $x$ and $y$ will be such that compound contains at least 10 mole percent of ethylene oxide. On the other hand, too much ethylene oxide would cause the other desired properties of the compound to decrease, thus the compound generally would not contain more than about 30 mole %.

A particular preferred inhibitor is n,tallow-n,n'n'-tris[ω-hydroxypolyoxethylene])-1,3-diaminopropane. The tallow used contains $C_{12}$, $C_{14}$, $C_{18}$ saturated acids and $C_{18}$ monoethenoid acids. Other similar acids are present but in relatively minor amounts. The tallow can be beef, goat or mutton. All of the aforementioned fatty acids are discussed in detail in Kirk-Othmer, Encyclopedia of Chemical Technology, 2nd Edition, Volume 8, Section Fat and Fatty Oils.

The potassium hydroxide helps control pH and thereby helps reduce corrosion; about 0.5 to 2 parts by weight are used.

Generally a small amount of a defoaming agent is incorporated in the composition. Usually about 0.03 to 0.5 parts by volume of defoamer is adequate. The dimethylsilicone polymers are particularly suitable defoamers.

Following are examples illustrating the preparation of the composition and its use. Also shown are comparative examples.

EXAMPLE

A composition was prepared containing 43.80 parts by weight of water, one part by weight of potassium hydroxide, 30.00 parts by volume of a block copolymer of polyethylene oxide and polypropylene oxide containing 40 weight percent ethylene oxide and 60 weight percent propylene oxide wherein the ethylene oxide was reacted to the ends of a propylene oxide polymer and having a molecular weight of 2200, 20.00 volume % of a reaction product of a sulfo-chlorinated fatty acid and ethylene oxide and containing 1.0 weight percent sulfur and 5.8 weight percent chlorine and having a saponification number of 70 and a viscosity at 100° F of 900 SUS and 5 parts by volume of n,tallow-n,n',n'-(tris[ω-hydroxypolyoxythylene]) 1,3-diaminopropane. This composition has a viscosity of 400–500 Saybolt Universal Seconds at 100° F. This viscosity gave the liquid good film strength and provided satisfactory lubrication for plain bearings and ways.

This composition was used in a cold-forming operation forming ¾ inch hexagonal nut blanks from a ¾ inch rod of AISI 1038 steel at a rate of 2 blanks per second. The steel rod initially was at ambient temperature and the final nut blanks were at 400° F due to the heat developed in the forming operation. The forming was done in 5 steps and each die used in these steps was flooded with the above composition. In this test nut blanks were fabricated at a rate of two per second for about 15 hours with satisfactory fluid performance and no abnormal maintenance which indicates satisfactory lubrication was achieved. The nut blanks had a bright metallic appearance indicating no overheating during the die-forming steps. This test is regarded as a very severe test of a metal-working lubricant.

In addition, a portion of the above-described liquid was placed into the lubricating side as well as the metal working side of a high speed bolt maker. The liquid replaced a recognized petroleum based cold heading liquid. The high speed bolt maker produced 120 1½ × ½ inch diameter cap screws a minute. Smoke was essentially eliminated. In addition, the following advantages resulted from a five month test:

1. the die used to make the threads on the bolts lasted longer;
2. less discoloration of the bolts;
3. better surface finish of bolts; and
4. fluid consumption was reduced.

Compared to other petroleum and other synthetic fluids, this composition showed a drastic reduction in smoke. Also because of its film strength it was possible to use it to lubricate plain bearings and ways and thereby avoided cross contamination of the cold working fluid by petroleum lubricating oil.

The following is a list of corrosion inhibitors which were tested and found, for some reason, unsatisfactory: oleic acid; sodium benzoate; tall oil fatty acid; a compound having the following structure:

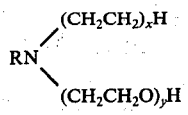

wherein R is derived from coco fatty acid or soya fatty acid or oleic acis; a compound having the following structure:

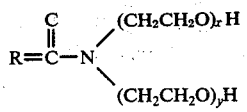

wherein R is derived from hydrogenated tallow acid or oleic acid; and a compound having the following structure:

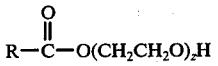

wherein R is derived from oleic acid or a 50-50 mixture of resin and fatty acids. In each of the aforementioned compounds containing ethylene oxide, the value of $x$, $y$ and $z$ either individually or collectively is such that the compound is water soluble.

The invention claimed is:

1. A liquid composition useful as a low smoking metal-working liquid comprising:

a. about 20–40 parts by weight of a block copolymer having a central portion of polypropylene oxide with polyethylene oxide on each end and the copolymer having a molecular weight of from about 1800 to 2900;

b. about 10–30 parts by volume of a sulfo-chlorinated fatty acid containing about 0.5 to 1.5 parts by weight of sulfur and about 4 to 7 parts by weight of chlorine;

c. about 1–10 parts by volume of a compound having the following structure:

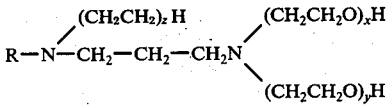

wherein R is a $C_{10}$–$C_{20}$ aliphatic group derived from tallow and the total value of $z$, $x$ and $y$ is such that the compound is water soluble;

d. amounts of potassium hydroxide, water and defoaming agent sufficient to make the liquid useful as a metal-working liquid.

2. Composition according to claim 1 wherein about 30 to 200 parts by weight of water and about 0.5 to 2 parts by weight of potassium hydroxide and about 0.03 to 0.5 parts by volume of a dimethylsilicone defoaming gent are present.

3. Composition according to claim 2 wherein the copolymer contains about 35 to 45 weight percent ethylene oxide.

4. Composition according to claim 3 wherein the copolymer has a molecular weight of about 2000 to 2400.

5. Composition according to claim 4 wherein the R of the compound is paraffinic or an alkyenyl.

6. Composition according to claim 1 wherein the compound is n,tallow-n,n',n'-(tris[ω-hydroxypolyoxethylene])-1,3-diaminopropane.

7. In a method of cold working a metal piece the improvement of applying to the metal being cold worked a liquid comprising:

a. about 20–40 parts by weight of a block copolymer having a central portion of polypropylene oxide with polyethylene oxide on each end and having a molecular weight of from about 1800 to 2900;

b. about 10–30 parts by volume of a sulfo-chlorinated fatty acid containing about 0.5 to 1.5 parts by weight of sulfur, about 4 to 7 parts by weight of chlorine;

c. about 1–10 parts by volume of a compound having the following structure:

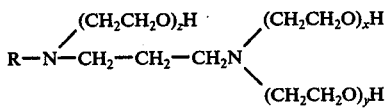

wherein R is a $C_{10}$–$C_{20}$ aliphatic group and the total value of $z$, $x$ and $y$ is such that the compound is water soluble;

d. amounts of potassium hydroxide, water and defoaming agent sufficient to make the liquid useful as a metal-working liquid.

8. Composition according to claim 7 wherein about 30 to 200 parts by weight of water and about 0.5 to 2 parts by weight of potassium hydroxide and about 0.03 to 0.5 parts by volume of a dimethylsilicone defoaming agent are present.

9. Composition according to claim 8 wherein the copolymer contains about 35 to 45 weight percent ethylene oxide.

10. Composition according to claim 9 wherein the copolymer has a molecular weight of about 2000 to 2400.

11. Composition accordding to claim 10 wherein the R of the compound is paraffinic or an alkyenyl.

12. Composition according to claim 11 wherein the compound is n,tallow-n,n',n'-(tris[ω-hydroxypolyoxethylene])- 1,3-diaminopropane.

* * * * *